US006511589B1

(12) United States Patent
Shindo

(10) Patent No.: US 6,511,589 B1
(45) Date of Patent: Jan. 28, 2003

(54) GOLD PLATING SOLUTION AND GOLD PLATING METHOD USING THEREOF

(75) Inventor: Yoshio Shindo, Kanagawa (JP)

(73) Assignee: Electroplating Engineers of Japan Limited, Tokyo (JP)

( * ) Notice: Subject to any disclaimer, the term of this patent is extended or adjusted under 35 U.S.C. 154(b) by 0 days.

(21) Appl. No.: 09/931,011

(22) Filed: Aug. 17, 2001

(51) Int. Cl.[7] ..... C25D 3/48; C23C 18/00

(52) U.S. Cl. ..... 205/267; 106/1.23; 106/1.26

(58) Field of Search ..... 205/267; 106/1.23, 106/1.26

(56) References Cited

PUBLICATIONS

El–Shazly et al., "Aqueous Bath and Method for Electroless Coating With Gold", Ger. Offen., 23 pp., no date available. Abstract only.*

* cited by examiner

*Primary Examiner*—Edna Wong
(74) *Attorney, Agent, or Firm*—Arent Fox Kintner Plotkin & Kahn

(57) ABSTRACT

A non-cyanide electrolytic gold plating solution excellent in its solution stability, and a method for gold plating using thereof. A non-cyanide electrolytic gold plating solution according to the present invention containing a trivalent gold compound which is a gold hydroxide salt and/or chloroaurate salt; a chelating agent which is a hydantoin compound of imidazolidinedione, 5,5-dimethylhydantoin, or hydantoic acid; a buffer; and a conductive salt, wherein the concentration of the gold in the gold plating solution is 0.5 to 30 g/L, the concentration of the chelating agent in the gold plating solution is 0.1 to 2.5 M/L, and pH is 5.0 to 10.0.

5 Claims, No Drawings

GOLD PLATING SOLUTION AND GOLD PLATING METHOD USING THEREOF

BACKGROUND OF THE INVENTION

1. Field of the Invention

The present invention relates to a non-cyanide electrolytic gold plating solution, and particularly relates to a gold plating solution excellent in its solution stability and capable of gold plating treatment with good plating properties, and a gold plating method using the solution.

2. Description of the Prior Art

Gold plating has been used not only for ornamental purposes or dinnerware, for example, for a long time but also in a wide range of industrial applications such as electronic and electric components and acoustic equipment components because of its excellent electrical characteristics.

Conventionally, most gold plating solutions were cyanide baths containing toxic gold potassium cyanide. However, the demand for a non-cyanide gold plating solution has recently been increasing due to problems concerning work-site safety or effluent treatment and to a problem concerning attacking a resist of a semiconductor component. Therefore, various kinds of non-cyanide gold platings have been suggested.

For example, many non-cyanide gold plating solutions use $Na_3Au(SO_3)_2$ as a gold salt. However, in a gold plating bath which uses $Na_3Au(SO_3)_2$, sulfite ions in the solution are unstable and easily oxidized by oxygen in the solution and by oxygen in the air, so that the concentration of the sulfite ions are spontaneously decreased. Consequently, the stability of gold complexes in the gold plating solution becomes lower and gold may precipitate. In addition, with the above described phenomena, a problem of inducing changes in plating properties would occur.

BRIEF SUMMARY OF THE INVENTION

Object of the Invention

The inventors have attempted, to provide a non-cyanide electrolytic gold plating solution excellent in its solution stability and a gold plating method using the solution.

Summary of the Invention

The inventors have made intensive studies to develop a non-cyanide electrolytic gold plating solution which is practically excellent, and have now found that the gold plating solution described below exhibits extremely outstanding performance.

The present invention is a non-cyanide electrolytic gold plating solution containing a trivalent gold compound which is a gold hydroxide salt and/or chloroaurate salt, a chelating agent which is a hydantoin compound selected from imidazolidinedione, 5,5-dimethylhydantoin, and hydantoic acid, a buffer, and a conductive salt, wherein the concentration of the gold in the gold plating solution is 0.5 to 30 g/L, the concentration of the chelating agent in the gold plating solution is 0.1 to 2.5 M/L, and pH is 5.0 to 10.0.

The gold plating solution according to the present invention, containing a chelating agent of a hydantoin compound, is excellent in its solution stability, and the gold precipitate will not be formed in the solution during the gold plating treatment. Further, the gold plating solution of the present invention can freely control a resultant appearance of the plating from a lustrous state to a lusterless state. Still further, a plating hardness among other plating properties is about 100 HV immediately after the plating treatment and 70 HV or less after the annealing (300° C., 300 min.).

When the chelating agent according to the present invention, that is, a hydantoin compound is used, the gold plating solution becomes extremely stable compared with other gold plating solutions which have conventionally been known. In other words, gold will not precipitate during the plating treatment. This is because the chelating agent is not reductive as in the case of sulfurous acid and has a property such that autolysis caused by pyrolysis or electrolysis hardly occurs. With the gold plating solution of the present invention which uses this chelating agent, it becomes possible to perform the plating treatment within a pH range around neutrality from weak acidity to weak alkalinity. Therefore, even when a photoresist (referred to as PR hereinafter) is coated on aplated substance, the gold plating treatment can be performed without dissolving the PR.

As a hydantoin compound which is the chelating agent used for the gold plating solution of the present invention, it is preferable to use any one of imidazolidinedione, 5,5-dimethylhydantoin, and hydantoic acid. This is because these compounds are excellent in capability of producing gold complexes and hardly cause autolysis resulted from pyrolysis or electrolysis.

In addition, it is preferable to use any of trivalent gold hydroxide salts and chloroaurate salts or a mixture thereof as the gold compound in the gold plating solution according to the present invention. In the gold plating solution according to the present invention, the gold may be supplied by the gold salts or gold complexes. A source of gold comprising any of the above described substances or a combination thereof has good compatibility with the above described chelating agent, so that the excellent solution stability can be obtained.

The concentration of the gold in the gold plating solution according to the present invention depends on an amount of the chelating agent contained, but is preferably in a range of 0.5 to 30 g/L. This is because electrodeposition will not occur without application of voltages of 3v or more when the concentration is less than 0.5 g/L, whereas a visual failure will occur when the gold concentration is above 30 g/L even when the concentration of the chelating agent is increased up to its upper limit. The concentration of the chelating agent, taking the above described gold concentrations into consideration, is preferably in a range of 0.1 to 2.5 M/L. This is because the chelating agent does not work as an effective complexing agent when its concentration of the chelating agent is less than 0.1 M/L, whereas salting-out will easily occur depending on the pH of the solution when the concentration of the chelating agent is above 2.5 M/L. Therefore, it can be said that the gold plating solution should preferably have a composition of concentration values within the above described ranges, in order to make the solution to be practical in gold plating operations.

As the conductive salt in the gold plating solution according to the present invention, it is preferable to use any one or more of hydrochloric acid, sulfuric acid, nitric acid, phosphoric acid, and salts thereof. When using the conductive salt comprising any one of the above described substances or a combination thereof, the solution stability of the gold plating solution according to the present invention becomes extremely excellent.

Further, as the buffer contained in the gold plating solution according to the present invention, it is preferable to use any one or more of boric acid, succinic acid, phthalic acid, tartaric acid, citric acid, phosphoric acid, and salts thereof. Using the buffer comprising any one of the above described substances or a combination thereof prevents the pH of the gold plating solution according to the present invention from largely fluctuating, and facilitates keeping its pH around neutrality from weak acidity to weak alkalinity (pH of about 5.0 to 10.0).

When the above described conductive salt and the buffer are contained in the.gold plating solution according to the present invention, preferably the concentration of the conductive salt should be 0.05 to 2.45 M/L, the concentration of the buffer should be 0.05 to 2.45 M/L, and the total concentration of the conductive salt and the buffer should be in a range of 0.1 to 2.5 M/L. When the concentration of the conductive salt is less than 0.05 M/L, a current efficiency becomes worse due to the reduction in its conductivity, and also a visual appearance of the plating tends to be deteriorated. In addition, when the concentration is above 2.45 M/L, the salting-out easily occurs depending on the pH value. On the other hand, the buffer does not exert its effect of stabilizing the pH when its concentration is less than 0.05 M/L, and the salting-out easily occurs depending on the pH value when the concentration is above 2.45 M/L. Still further, when the total concentration of the conductive salt and the buffer is 0.1 to 2.5 M/L, the gold plating solution according to the present invention becomes practically the most excellent as a whole. That is, the solution stability is improved, the current efficiency becomes higher, and the pH of the plating solution is prevented from largely fluctuating.

When the gold plating treatment is performed with the above described non-cyanide electrolytic gold plating solution according to the present invention, the electrolytic plating should preferably be conducted under the conditions of the pH of the plating solution of 5.0 to 10.0, a temperature of the solution of 20 to 70° C., and a current density of 0.1 to 4.5 A/dm$^2$.

In this case, the pH value of the gold plating solution becomes within a range of pH5.0 to 10.0 depending on the concentrations of the buffer and the conductive salt, and an abnormal appearance does not occur in the deposited gold plating as long as the pH value is within this range. Non-uniform appearance of the plating will occur when the pH becomes less than 5.0, whereas the PR will tend to be dissolved if the PR is coated on a substance to be plated when the pH becomes above 10.0.

The reason why the temperature of the gold plating solution should be set within a range of 20 to 70 ° C. is as follows. That is, when the temperature be comes less than 20° C., the gold plating solution will not be useful because fluctuation in the plating treatment becomes substantially too large. On the other hand, when the temperature becomes above 70° C., luster of the deposited gold plating will adversely be affected by the temperature and a life of the solution will abruptly decreases.

The range of the current density, 0.1 to 4.5 A/dm$^2$, has been determined by confirming that the properties of the deposited gold plating become extremely good situations, taking the above described pH value of the gold plating solution, the solution temperature, and the gold concentration into consideration. The properties of the plating in this case are meant that overall capacity including appearance, adhesive property, leveling, hardness or the like.

According to the above described gold plating method using the gold plating solution according to the present invention, the hardness of the deposited gold plating is about 100 HV (vickers hardness, this is the same hereinafter) immediately after the plating treatment, and 70 HV or less after the annealing under the condition of 300° C.×30 min. The gold plating having such a characteristic including the above described hardness is effective as a bump deposit for IC implementation. In addition, using the gold plating solution according to the present invention, the solution becomes excellent in its long-term stability and also possible to be used for a long time.

DETAILED DESCRIPTION OF THE PREFERRED EMBODIMENTS

Now, a non-cyanide electrolytic gold plating solution according to the present invention and a method for gold plating using thereof will be described in further detail, by way of some embodiments which are assumed to be optimum for the present invention.

First Embodiment

Firstly, with reference to Examples 1 to 15 shown in Table 1 below the gold strike plating will be explained.

TABLE 1

| | Au (g/L) | Chelating agent (M/L) | Conductive salt (M/L) | Buffer (M/L) | pH | Solution temperature ° C. | Additive ppm | Evaluation of adhesion | Evaluation of stability |
|---|---|---|---|---|---|---|---|---|---|
| Example 1 | 0.5 | A:0.1 | 0.5 | 0.5 | 7.5 | 50 | — | ○ | 1 |
| Example 2 | 0.5 | B:0.1 | 0.5 | 0.5 | 7.5 | 50 | — | ◎ | 1 |
| Example 3 | 0.5 | C:0.1 | 0.5 | 0.5 | 7.5 | 50 | — | ◎ | 1 |
| Example 4 | 0.5 | D:0.1 | 0.5 | 0.5 | 7.5 | 50 | — | ○ | 1 |
| Example 5 | 0.5 | E:0.1 | 0.5 | 0.5 | 7.5 | 50 | — | ◎ | 1 |
| Example 6 | 1.0 | A:0.3 | 0.1 | 1.0 | 6.0 | 50 | T1:1 | ◎ | 1 |
| Example 7 | 1.0 | B:0.3 | 0.1 | 1.0 | 6.0 | 50 | T1:1 | ◎ | 1 |
| Example 8 | 1.0 | C:0.3 | 0.1 | 1.0 | 6.0 | 50 | Pb:1 | ○ | 1 |
| Example 9 | 1.0 | D:0.3 | 0.1 | 1.0 | 6.0 | 50 | Pb:1 | ○ | 1 |
| Example 10 | 1.0 | E:0.3 | 0.1 | 1.0 | 6.0 | 50 | Pb:1 | ◎ | 1 |
| Example 11 | 1.5 | A:0.2 | 0.25 | 0.8 | 8.0 | 50 | T1:10 | ◎ | 1 |
| Example 12 | 1.5 | B:0.2 | 0.25 | 0.8 | 8.0 | 50 | T1:10 | ◎ | 1 |
| Example 13 | 1.5 | C:0.2 | 0.25 | 0.8 | 8.0 | 50 | Pb:10 | ◎ | 1 |
| Example 14 | 1.5 | D:0.2 | 0.25 | 0.8 | 8.0 | 50 | Pb:10 | ○ | 1 |
| Example 15 | 1.5 | E:0.2 | 0.25 | 0.8 | 8.0 | 50 | Pb:10 | ○ | 1 |

Chelating agents A to E described in Table 1 are as follows. A is imidazolidinedione (a hydantoin), B is 5,5-dimethylhydantoin (a hydantoin compound), C is pyrimidinedione (uracil), D is succinimide, and E is phthalimide.

Nitrates are used as a conductive salt, and phosphates are used as a buffer. Additives Tl and Pb were added in order to regulate crystals of the gold plating. Evaluation of adhesion in Table 1 shows a result obtained from a simple peel test (a method for determining whether the plating is peeled off or not, by applying a pressure-sensitive tape to a surface to be treated by plating and peeling off the tape from the surface), and the results of the evaluation are represented by symbols as follows. A symbol ⊚ represents that the adhesion is very good, a symbol ○ represents that the adhesion is good, a symbol Δ represents that some difficulties are practically present in its adhesion, and a symbol X represents that the adhesion is bad.

In addition, evaluation of stability in Table 1 exhibits whether the gold precipitates were formed or not in the plating solution, by using two kinds of numerical values as follows. In the case where the gold precipitates were not formed in the plating solution, the numerical value of the evaluation of stability 1 was indicated in the table, on the other hand, in the case where the gold precipitates were formed in the plating solution, the numerical value of the evaluation of stability 2 was indicated in the table.

Table 2 described below shows the case where the strike plating treatment was performed with a gold plating solution including conventionally used sulfurous acid as a chelating agent as Comparative Examples. Evaluation of adhesion and evaluation of solution stability in the Comparative Examples are indicated using the symbols and numerical values described in Table 1. Sulfites were used as the chelating agent and the conductive salt in Table 2.

Conditions of the strike plating treatment described in this first embodiment were as follows. Using plating solutions whose composition is described in Table 1 and Table 2 and Ni-plated Cu plates as objects to be plated, plating was performed with the current density of 3.0 A/dm$^2$. The stability was evaluated, by continuous gold plating treatment while an object to be plated was replaced with another to investigate whether the gold precipitates were formed or not.

As can be seen in Table 1 and Table 2, in Examples 1 to 15, it has been confirmed that the strike plating showing good adhesion could be performed and the gold precipitates were not formed. On the other hand, in Comparative Examples in which conventionally used sulfurous acid was used as the chelating agent, results were obtained such that the plating solution was lacking in its stability, and the gold precipitates were formed after the plating treatment about ten hours.

Second Embodiment

Next, with reference to Examples 16 to 30 in Table 3 shown below the gold heavy plating will be explained.

TABLE 2

| | Au (g/L) | Chelating agent (M/L) | Conductive salt (M/L) | pH | solution temperature ° C. | Additive ppm | Evaluation of adhesion | Evaluation of stability |
|---|---|---|---|---|---|---|---|---|
| Comparative Example 1 | 0.5 | 0.5 | 0.3 | 8.0 | 50 | — | ○ | 2 |
| Comparative Example 2 | 1.0 | 0.5 | 0.3 | 8.0 | 50 | — | Δ | 2 |
| Comparative Example 3 | 1.5 | 0.5 | 0.3 | 8.0 | 50 | — | Δ | 2 |

TABLE 3

| | Au (g/L) | Chelating agent (M/L) | Conductive salt (M/L) | Buffer (M/L) | pH | Solution temperature ° C. | Additive ppm | Evaluation of adhesion | Evaluation of stability |
|---|---|---|---|---|---|---|---|---|---|
| Example 16 | 8.0 | A:0.5 | 1.0 | 0.5 | 7.0 | 50 | T1:1 | ○ | 1 |
| Example 17 | 8.0 | B:0.5 | 1.0 | 0.5 | 7.0 | 50 | T1:1 | ⊚ | 1 |
| Example 18 | 8.0 | C:0.5 | 1.0 | 0.5 | 7.0 | 50 | T1:1 | ⊚ | 1 |
| Example 19 | 8.0 | D:0.5 | 1.0 | 0.5 | 7.0 | 50 | Pb:1 | ○ | 1 |
| Example 20 | 8.0 | E:0.5 | 1.0 | 0.5 | 7.0 | 50 | Pb:1 | ⊚ | 1 |
| Example 21 | 14.0 | A:0.75 | 1.5 | 0.5 | 7.5 | 50 | T1:10 | ⊚ | 1 |
| Example 22 | 14.0 | B:0.75 | 1.5 | 0.5 | 7.5 | 50 | T1:10 | ⊚ | 1 |
| Example 23 | 14.0 | C:0.75 | 1.5 | 0.5 | 7.5 | 50 | T1:10 | ○ | 1 |
| Example 24 | 14.0 | D:0.75 | 1.5 | 0.5 | 7.5 | 50 | Pb:10 | ○ | 1 |
| Example 25 | 14.0 | E:0.75 | 1.5 | 0.5 | 7.5 | 50 | Pb:10 | ⊚ | 1 |
| Example 26 | 30.0 | A:1.0 | 2.0 | 0.5 | 8.0 | 50 | T1:25 | ⊚ | 1 |
| Example 27 | 30.0 | B:1.0 | 2.0 | 0.5 | 8.0 | 50 | T1:25 | ⊚ | 1 |

TABLE 3-continued

| | Au (g/L) | Chelating agent (M/L) | Conductive salt (M/L) | Buffer (M/L) | pH | Solution temperature ° C. | Additive ppm | Evaluation of adhesion | Evaluation of stability |
|---|---|---|---|---|---|---|---|---|---|
| Example 28 | 30.0 | C:1.0 | 2.0 | 0.5 | 8.0 | 50 | T1:25 | ○ | 1 |
| Example 29 | 30.0 | D:1.0 | 2.0 | 0.5 | 8.0 | 50 | Pb:25 | ○ | 1 |
| Example 30 | 30.0 | E:1.0 | 2.0 | 0.5 | 8.0 | 50 | Pb:25 | ◎ | 1 |

Chelating agents A to E, conductive salts, and buffers shown in Table 3 are the same as those described in Table 1, and evaluation of adhesion and evaluation of solution stability are also the same as those described in Table 1, so the definition of each terms will not be repeated.

Table 4 shown below describes the gold heavy plating treatment using as the chelating agent conventionally used sulfurous acid as Comparative Examples. Evaluation of adhesion and evaluation of solution stability in these Comparative Examples are also indicated using the symbols and numerical values described in Table 1.

TABLE 2

| | Au (g/L) | Chelating agent (M/L) | Conductive salt (M/L) | pH | solution temperature ° C. | Additive ppm | Evaluation of adhesion | Evaluation of stability |
|---|---|---|---|---|---|---|---|---|
| Comparative Example 4 | 8.0 | 1.0 | 0.3 | 8.0 | 50 | T1:10 | Δ | 2 |
| Comparative Example 5 | 14.0 | 1.5 | 0.3 | 8.0 | 50 | T1:10 | ○ | 2 |

Conditions of the heavy plating treatment described in this second embodiment were as follows. Using plating solutions whose composition is described in Table 3 and Table 4 and Cu plates as objects to be plated, the plating treatment was performed with the current density of 2 A/dm$^2$ until the thickness of the plating became about 20 $\mu$m. The stability was evaluated by continuous gold plating treatment while an object to be plated was replaced with another to investigate whether the gold precipitates were formed or not.

As can be seen in Table 3 and Table 4, in Examples 16 to 30, it has been confirmed that the heavy plating showing good adhesion could be performed and the gold precipitates were not formed. On the other hand, in Comparative Examples in which conventionally used sulfurous acid was used as the chelating agent, results were obtained such that the plating solution was lacking in its stability, and the gold precipitates were formed after the plating treatment for about ten hours.

The hardness of the gold which was obtained from the plating treatment according to each of Examples 16 to 30 and Comparative Examples 4 to 6 was measured by a Vickers hardness meter (loaded 25 gf). The results are summarized in Table 5. The hardness measurement of the gold plating was conducted after the plating treatment and after the annealing (300° C.×30 min, under the $N_2$ atmosphere). In addition, current efficiency in each plating solution is calculated and summarized in the table.

TABLE 5

| | Property of plating layer Vickers hardness | | |
|---|---|---|---|
| | after plating | after annealing | Current efficiency (%) |
| Example 16 | 95.8 | 55.6 | 98.2 |
| Example 17 | 83.2 | 58.1 | 97.1 |
| Example 18 | 80.1 | 40.3 | 98.0 |
| Example 19 | 90.5 | 45.2 | 96.3 |

TABLE 5-continued

| | Property of plating layer Vickers hardness | | |
|---|---|---|---|
| | after plating | after annealing | Current efficiency (%) |
| Example 20 | 99.2 | 50.8 | 98.3 |
| Example 21 | 98.6 | 58.3 | 98.3 |
| Example 22 | 90.3 | 50.1 | 97.4 |
| Example 23 | 85.6 | 53.6 | 99.0 |
| Example 24 | 79.9 | 48.2 | 97.1 |
| Example 25 | 79.2 | 55.5 | 98.8 |
| Example 26 | 93.7 | 56.9 | 99.1 |
| Example 27 | 91.8 | 53.2 | 98.2 |
| Example 28 | 77.9 | 51.3 | 97.8 |
| Example 29 | 85.3 | 58.1 | 97.9 |
| Example 30 | 92.1 | 49.8 | 98.1 |
| Comparative Example 4 | 80.7 | 52.3 | 99.8 |
| Comparative Example 5 | 98.3 | 48.2 | 99.9 |

It has been found that, from the results obtained from Examples 16 to 30 in Table 5, the value of hardness of the gold plating is from 77.9 to 99.2 HV after the plating treatment, and is from 49.8 to 58.3 HV after the annealing. In Comparative Examples 4 and 5, the value of hardness is from 100 to 80 HV after the plating treatment and is from 60 to 40 HV after the annealing. So it has been found that the properties of Examples are equivalent to those of Comparative Examples 4 and 5.

As described above, according to the non-cyanide electrolytic gold plating solution of the present invention, the plating solution maintains it high stability, and the plating treatment can be continuously performed for a long time without forming the gold precipitates during the gold plating. Further, even when the PR which is easily dissolved in the plating solution is coated on an object to be treated, the gold plating treatment can be performed without dissolving the PR. Still further, since the obtained gold plating can provide the value of hardness of 60 HV or less after the annealing, the plating can be suitable for the bump deposits used for the IC implementation.

What is claimed is:

1. A electrolytic gold plating solution containing: a trivalent gold compound comprising a gold hydroxide salt and/or chloroaurate salt; a chelating agent comprising a hydantoin compound of imidazolidinedione, 5,5-dimethylhydantoin, or hydantoic acid; a buffer; and a conductive salt, wherein the concentration of the gold in the gold plating solution is 0.5 to 30 g/L, the concentration of the chelating agent in the gold plating solution is 0.1 to 2.5 M/L, pH is 5.0 to 10.0, and the electrolytic gold plating solution does not contain cyanide.

2. The electrolytic gold plating solution according to claim 1, wherein the conductive salt comprises any one or more of hydrochloric acid, sulfuric acid, nitric acid, phosphoric acid, or salts thereof.

3. The electrolytic gold plating solution according to claim 1, wherein the buffer comprises any one or more of boric acid, succinic acid, phthalic acid, tartaric acid, citric acid, phosphoric acid, or salts thereof.

4. The electrolytic gold plating solution according to claim 1, wherein the concentration of the conductive salt contained in the gold plating solution is 0.05 to 2.45 M/L, the concentration of the buffer contained in the gold plating solution is 0.05 to 2.45 M/L, and the total concentration of the conductive salt and the buffer is 0.1 to 2.5 M/L.

5. A method for electroplating treatment using the gold plating solution according to claim 1, wherein electrolysis is conducted under the conditions of a solution temperature of 20 to 70° C., and a current density of 0.1 to 4.5 A/d $m^2$.

* * * * *